US012522909B2

(12) United States Patent
Vu et al.

(10) Patent No.: US 12,522,909 B2
(45) Date of Patent: Jan. 13, 2026

(54) COATED STEEL SUBSTRATE

(71) Applicant: ArcelorMittal, Luxembourg (LU)

(72) Inventors: Thi Tan Vu, Oviedo (ES); Laura Megido Fernandez, Gijon Asturias (ES); Carlota Dominguez Fernandez, Gijon Asturias (ES); Jorge Rodriguez Garcia, Gijon Asturias (ES); David Noriega Perez, Oviedo Asturias (ES); Roberto Suarez Sanchez, Aviles Asturias (ES); Cristina Blanco Roldan, El Entrego Asturias (ES)

(73) Assignee: ArcelorMittal, Luxembourg (LU)

( * ) Notice: Subject to any disclaimer, the term of this patent is extended or adjusted under 35 U.S.C. 154(b) by 724 days.

(21) Appl. No.: 17/771,568

(22) PCT Filed: Oct. 29, 2020

(86) PCT No.: PCT/IB2020/060138
§ 371 (c)(1),
(2) Date: Apr. 25, 2022

(87) PCT Pub. No.: WO2021/084458
PCT Pub. Date: May 6, 2021

(65) Prior Publication Data

US 2022/0411911 A1 Dec. 29, 2022

(30) Foreign Application Priority Data

Oct. 29, 2019 (WO) ..... PCT/IB2019/059255

(51) Int. Cl.
*C23C 2/04* (2006.01)
*C22C 38/40* (2006.01)
(Continued)

(52) U.S. Cl.
CPC ..... *C23C 2/04* (2013.01); *C22C 38/40* (2013.01); *C23C 2/0034* (2022.08);
(Continued)

(58) Field of Classification Search
CPC ..... C23C 2/04; C23C 2/0034; C23C 2/00344; C23C 2/00348; C23C 2/0038; C23C 2/40;
(Continued)

(56) References Cited

U.S. PATENT DOCUMENTS 4,479,824 A * 10/1984 Schutt ..... C09D 1/04 106/14.39
2005/0009711 A1* 1/2005 Hinterwaldner ..... C09D 7/40 29/700

(Continued)

FOREIGN PATENT DOCUMENTS

CN 101696328 A 4/2010
CN 201172680 Y 12/2018

(Continued)

OTHER PUBLICATIONS

Aalco, "Stainless Steels—Specifications, Grade, and Properties and Grade 304 Stainless Steel: Properties, Fabrication, and Applications," online article, May 2005 (Year: 2005).*

(Continued)

*Primary Examiner* — Danielle M. Carda
(74) *Attorney, Agent, or Firm* — Davidson Kappel LLC

(57) ABSTRACT

A coated stainless-steel substrate including a coating including nanographites and a binder being sodium silicate, wherein the stainless-steel substrate has the following composition in weight percent: C≤1.2%, Cr≥11.0%, Ni≥8.0% and on a purely optional basis, one or more elements such as Nb≤6.0%, B≤1.0%, Ti≤3.0%, Cu≤5.0%, Co≤3.0%, N≤1.0%, V≤3.0%, Si≤4.0%, Mn≤5.0%, P≤0.5%, S≤0.5%, Mo≤6.0%, Ce≤1.0%, the remainder of the composition being made of iron and inevitable impurities resulting from the elaboration. A method for the manufacture of this coated stainless-steel substrate is also provided.

22 Claims, 1 Drawing Sheet

(51) Int. Cl.
*C23C 2/00* (2006.01)
*C23C 2/40* (2006.01)

(52) U.S. Cl.
CPC ..... *C23C 2/00344* (2022.08); *C23C 2/00348* (2022.08); *C23C 2/0038* (2022.08); *C23C 2/40* (2013.01)

(58) Field of Classification Search
CPC ..... C23C 2/06; C23C 24/082; C23C 2/0032; C22C 38/40; C22C 38/42; C22C 38/001; C22C 38/002; C22C 38/005; C22C 38/44; C22C 38/48; C22C 38/50; C22C 38/52; C22C 38/54; C04B 2111/00525; C04B 14/024; C04B 28/26; C04B 20/008; B05D 7/14; B05D 7/24
USPC ..... 420/112
See application file for complete search history.

(56) References Cited

U.S. PATENT DOCUMENTS

2011/0200825 A1* 8/2011 Chakraborty ..... B05D 3/062 428/524
2016/0024310 A1* 1/2016 McMullin ..... C09D 7/62 523/400
2019/0177808 A1* 6/2019 Kurihara ..... C22C 38/02
2020/0282454 A1 9/2020 Cabanas Corrales et al.

FOREIGN PATENT DOCUMENTS

| | | | |
|---|---|---|---|
| EP | 0684323 | A1 | 11/1995 |
| JP | H03153855 | A | 7/1991 |
| JP | H06212379 | A | 8/1994 |
| JP | 2006502308 | A | 1/2006 |
| JP | 2012082488 | A | 4/2012 |
| WO | WO2019122957 | A1 | 6/2019 |
| WO | WO 2019122958 | A1 | 6/2019 |
| WO | WO2019123103 | A1 | 6/2019 |

OTHER PUBLICATIONS

Search Report of PCT/IB2020/060138 dated Nov. 27, 2020.
Written Opinion of PCT/IB2020/060138.
Albert V. Tamashausky, Graphite a Multifunctional Additive for Paint and Coatings, Oct. 2003, pp. 64-79 (Year: 2003).
Radyuk, AG et al. "Exerience of application of a heat-resistant coating to protect billets in heating for metal forming." 2015, Russian Metallurgy 13. p. 1-4 (Year (2015).
"Graphite" Oct. 2016. Asbury Carbons. Retrieved from: http://web.archive.org/web/20161010120828/https://asbury.com/materials/graphite/ (Year: 2016).

* cited by examiner

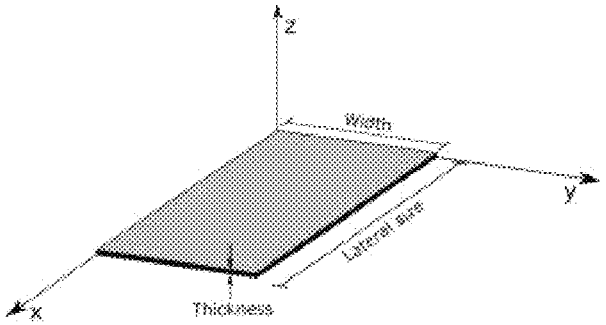
z
Width
y
Lateral size
x
Thickness

COATED STEEL SUBSTRATE

The present invention relates to a coating intended for the protection, against molten metal corrosion, of stainless steel used as parts in the hot-dip coating process of steel strips. The present invention also relates to the method for the manufacture of the coated stainless steel thereof and to the process of hot dip coating with recourse to the coated stainless steel thereof.

BACKGROUND

Usually, in the steel route production, steel strips are coated with a metallic coating deposited by hot-dip coating, i.e. hot-dip galvanizing or hot-dip aluminizing. This metallic coating contains elements typically selected notably among Zinc, Aluminium, Silicon, and Magnesium. These elements are melted in a bath through which the steel strip runs. To do so, some metallic devices or parts, such as the snout, the sink roll, the stabilizing rolls, pipelines or pumping elements are in direct contact with the molten bath.

SUMMARY OF THE INVENTION

During such contact, a reaction takes place between the molten metal and the immersed part. In particular, Zn and/or Al form intermetallic compounds with the iron of the metallic device, which results in an embrittlement of the immersed part. To limit this corrosion induced by the molten metal, the metallic devices or parts to be used in contact with the molten metal are usually made of stainless steel. Despite the improvement of the resistance to molten metal corrosion, the stainless steel in contact with the molten metal keeps corroding, which leads to deformations, embrittlements and breakdowns. For example, the lower part of a snout made of stainless steel can be immerged during months in a molten bath. During this immersion, the molten metal attacks the snout, which results in a thinner snout wall thickness which together with high temperature condition causes the cracking of the tool. Because of the molten metal corrosion, the snout must often be inspected, maintained and replaced. These regular inspections, maintenances and replacements are done at the expense of line stops, which seriously impair the production of hot-dip coated steel strips.

The patent application CN201172680 discloses a snout for a cold-rolled steel strip galvanization bath including an upper and a lower frames, the upper frame being made of welded stainless steel plates and the lower frame being made of an aluminum oxide ceramic.

Nevertheless, this snout comprising two parts made of two materials, i.e. stainless steel and aluminum oxide ceramic, is difficult to produce. Indeed, the aluminum oxide ceramic is casted to form the lower part of the snout. The melting point of the aluminum oxide is very high, around 2000° C. Thus, new equipment are needed to produce such part, which significantly impact the cost of such snout.

It is an object of the present invention to provide a stainless steel substrate well protected against molten metal corrosion so that inspections, maintenances and replacements are limited and so that embrittlement, deformation and breakdowns are further prevented. Moreover, a further alternate or additional object of the invention is to provide an easy-to-implement method for producing this stainless steel substrate without replacing the current equipment in the hot-dip galvanizing lines and hot-dip aluminizing lines.

The present invention provides a coated stainless-steel substrate comprising a coating comprising nanographites and a binder being sodium silicate, wherein the stainless-steel substrate has the following composition in weight percent:

- C≤1.2%,
- Cr≥11.0%,
- Ni≥8.0%
- and on a purely optional basis, one or more elements such as
  - Nb≤6.0%,
  - B≤1.0%,
  - Ti≤3.0%,
  - Cu≤5.0%,
  - Co≤3.0%,
  - N≤1.0%,
  - V≤3.0%,
  - Si≤4.0%,
  - Mn≤5.0%,
  - P≤0.5%,
  - S≤0.5%,
  - Mo≤6.0%,
  - Ce≤1.0%,
- the remainder of the composition being made of iron and inevitable impurities resulting from the elaboration.

The coated stainless-steel substrate according to the invention may also have the optional features listed below, considered individually or in combination:

- the lateral size of the nanographites is between 1 and 65 μm,
- the width size of the nanographites is between 2 to 15 μm,
- the thickness of the nanographites is between 1 to 100 nm,
- the concentration of nanographites in the coating is between 5% and 70% by weight,
- the concentration of sodium silicate in the coating is between 35% and 75% by weight,
- the ratio in weight of nanographites with respect to the binder is between 0.05 and 0.9,
- the thickness of the coating is between 10 and 250 μm,
- the coating further comprises clay, silica, quartz, kaolin, aluminium oxide, magnesium oxide, silicon oxide, titanium oxide, Yttrium oxide, zinc oxide, aluminium titanate, carbides or mixtures thereof.

The present invention also provides a method for the manufacture of a coated stainless-steel substrate comprising the successive following steps:

A. The provision of a stainless-steel substrate comprising in weight percent at most 1.2% C, at least 11.0% Cr and at least 8.0% Ni, the remainder of the composition being made of iron and inevitable impurities resulting from the elaboration, B. The deposition on at least a part of the stainless-steel substrate of an aqueous mixture comprising nanographites and a binder being sodium silicate to form a coating, C. Optionally, the drying of the coating obtained in step B).

The method for the manufacture of a coated stainless-steel substrate according to the invention may also have the optional features listed below, considered individually or in combination:

- in step B), the deposition of the coating is performed by spin coating, spray coating, dip coating or brush coating,
- in step B), the aqueous mixture comprises from 40 to 110 g/L of nanographites and from 40 to 80 g/L of binder,
- in step C), when a drying is applied, the drying is performed at a temperature between 50 and 150° C., in step C), when a drying is applied, the drying is performed during 5 to 60 minutes.

The present invention also provides a process of hot dip coating a steel strip comprising a step of moving the steel strip through a molten metal bath comprising a piece of equipment at least partially immersed in the bath wherein at least a part of the piece of equipment is made of a coated stainless-steel substrate according to the invention.

The present invention further provides a hot dip coating facility comprising a molten metal bath comprising a piece of equipment at least partially immersed in the bath wherein at least a part of the piece of equipment is made of a coated stainless-steel substrate according to the invention.

The piece of equipment of the hot dip coating facility is optionally selected among a snout, an overflow, a sink roll, a stabilizing roll, a roll supporting arm, a roll flange, a pipeline and a pumping element.

BRIEF DESCRIPTION OF THE DRAWINGS

To illustrate the invention, various embodiments and trials of non-limiting examples will be described, particularly with reference to FIG. 1 which illustrates the usual shape of a nanographite according to the present invention.

DETAILED DESCRIPTION

Other characteristics and advantages of the invention will become apparent from the following detailed description of the invention.

The following terms are defined:

Nanographite refers to a carbon-based nanomaterial made of graphene nanoplatelets, i.e. stacks of a few graphene sheets having a platelet shape as illustrated on FIG. 1. On this FIGURE, the lateral size means the highest length of the nanoplatelet through the X axis and the thickness means the height of the nanoplatelet through the Z axis. The width of the nanoplatelet is illustrated through the Y axis.

Preferably, the lateral size of the nanographites is between 1 and 65 μm, advantageously between 2 and 15 μm and more preferably between 2 and 10 μm.

Preferably, the width size of the nanographites is between 2 and 15 μm. Advantageously, the thickness of the nanographites is between 1 nm and 100 nm, more preferably between 1 and 50 nm, even more preferably between 1 and 10 nm.

Graphite nanoplatelet is a synonym of nanographite.

Substrate refers to a material which provides the surface on which something is deposited. This material is not limited in terms of size, dimensions and shapes. It can notably be in the form of a strip, a sheet, a piece, a part, an element, a device, an equipment . . . . It can be flat or shaped by any means.

"coated" means that the substrate is at least locally covered with the coating. The covering can be for example limited to the area of the substrate to be immersed in the molten metal bath. "coated" inclusively includes "directly on" (no intermediate materials, elements or space disposed therebetween) and "indirectly on" (intermediate materials, elements or space disposed therebetween). For example, coating the substrate can include applying the coating directly on the substrate with no intermediate materials/elements therebetween, as well as applying the coating indirectly on the substrate with one or more intermediate materials/elements therebetween.

Hot-dip coating process refers to the process of hot-dip galvanizing, when the coating is zinc-based, and to the process of hot-dip aluminizing, when the coating is aluminium-based.

Without willing to be bound by any theory, it seems that a coating comprising nanographites and a binder being sodium silicate on the stainless-steel substrate acts like a barrier to molten metal attack and prevents the formation of Zn—Fe and/or Al—Fe intermetallic compounds. Indeed, the coating according to the present invention is non-wetting with regard to the elements of the molten metal bath due to its graphitic content. In particular, it seems that nanographites are not wetted by liquid Zinc and/or Aluminium. The nanographites thus act as the non-wetting agent while sodium silicate acts as binder and adhesion promoter to the stainless steel surface. The non-adhesion of the molten metal elements to the stainless-steel surface leads to an increase of the corrosion resistance, a decrease of the deformation risk of the substrate and a longer lifetime of the substrate. Moreover, the coating comprising sodium silicate well adheres on the stainless-steel substrate so that the stainless-steel substrate is even more protected. It further prevents the risk of coating cracks and coating detachment, which would expose the stainless-steel substrate to molten metal attack and deformation.

These advantages of the coating according to the invention are provided in all kinds of molten bath compositions in use on hot-dip coating lines. The molten metal bath composition can be zinc-based. Examples of zinc-based baths and coatings are: zinc comprising 0.2% of Al and 0.02% of Fe (HDG coating), zinc alloy comprising 5 wt. % of aluminium (Galfan® coating), zinc alloy comprising 55 wt. % of aluminium, about 1.5 wt. % of silicon, the remainder consisting of zinc and inevitable impurities due to the processing (Aluzinc®, Galvalume® coatings), zinc alloy comprising 0.5 to 20% of aluminium, 0.5 to 10% of magnesium, the remainder consisting of zinc and inevitable impurities due to the processing, zinc alloys comprising aluminium, magnesium and silicon, the remainder consisting of zinc and inevitable impurities due to the processing.

The molten metal bath composition can be also aluminium-based. Examples of aluminium-based baths and coatings are: aluminium alloy comprising from 8 to 11 wt. % of silicon and from 2 to 4 wt. % of iron, the remainder consisting of aluminium and inevitable impurities due to the processing (Alusi® coating), aluminium (Alupur® coating), aluminium alloys comprising zinc, magnesium and silicon, the remainder consisting of aluminium and inevitable impurities due to the processing.

The stainless-steel substrate is an austenitic stainless steel. Accordingly, it comprises at most 1.2 wt % C, at least 11.0 wt % Cr and at least 8.0 wt % Ni.

Preferably, the amount of C is below or equal to 0.5% by weight and advantageously below or equal to 0.3% by weight.

Preferably, the amount of Cr is below or equal to 30% by weight and more preferably below or equal to 25% by weight.

Preferably, the amount of Ni is below or equal to 30% by weight and more preferably below or equal to 25% by weight.

Optionally, the amount of Nb is below or equal to 3.0% by weight, more preferably below or equal to 2.0% by weight.

Optionally, the amount of B is below or equal to 0.3% by weight.

Optionally, the amount of Ti is below or equal to 1.0% by weight.

Optionally, the amount of Cu is below or equal to 3.0% by weight, more preferably below or equal to 1.0% by weight.

Optionally, the amount of Co is below or equal to 1.0% by weight.

Optionally, the amount of N is below or equal to 0.5% by weight.

Optionally, the amount of V is below or equal to 1.0% by weight.

Optionally, the amount of Si is between 0.5 and 2.5% by weight.

Optionally, the amount of Mn is below or equal to 3.0% by weight, more preferably below or equal to 2.5% by weight.

Optionally, the amount of P is below or equal to 0.1% by weight.

Optionally, the amount of S is below or equal to 0.1% by weight.

Optionally, the amount of Mo is between 0.5 and 2.5% by weight.

Optionally, the amount of Ce is below or equal to 0.1% by weight.

The possible inevitable impurities resulting from the elaboration are mainly P, S and N in the amounts described above.

Examples of stainless-steel substrate are 316 and 253MA.

The stainless-steel substrate can be notably any piece or part to be immersed at least partially in a molten metal bath. Preferably, the stainless-steel substrate is a snout, an overflow, a sink roll, a stabilizing roll, a roll supporting arm, roll flanges, a pipeline or a pumping element or a part of these elements.

The stainless-steel substrate is at least partially coated with a coating comprising nanographites and a binder being sodium silicate.

The concentration of nanographites in the coating is preferably between 1 to 70% by weight of dry coating, more preferably between 5 and 70 wt %, even more preferably between 10 and 65 wt %. Such concentrations provide a good balance between non-adhesion of the molten metal elements on the coating and adhesion of the coating to the substrate.

Preferably, the nanographites contain more than 95% by weight of C and advantageously more than 99%.

The binder is sodium silicate. In other words, the binder is obtained from sodium silicate. This sodium silicate reacts during the drying phase so as to form rigid siloxane chains. It is believed that the siloxane chains get attached to the hydroxyl groups present on the surface of the stainless steel substrate. It is also believed that the sodium silicate dissolved in the aqueous mixture applied on the substrate will penetrate in all the crevices from the substrate surface and, after drying, will become tough and vitreous therefore anchoring the coating to the substrate.

Sodium silicate refers to any chemical compound with the formula $Na_{2x}Si_yO_{2y+x}$ or $(Na_2O)_x \cdot (SiO_2)_y$. It can notably be sodium metasilicate $Na_2SiO_3$, sodium orthosilicate $Na_4SiO_4$, sodium pyrosilicate $Na_6Si_2O_7$, $Na_2Si_3O_7$.

The concentration of sodium silicate in the coating is preferably between 35% to 95% by weight of dry coating, more preferably between 35 and 75 wt %. Such concentrations provide a good balance between non-adhesion of the molten metal elements on the coating and adhesion of the coating to the substrate.

According to one variant of the invention, the coating further comprises additives, notably to improve its thermal stability and/or its abrasion resistance. Such additives can be selected among clay, silica, quartz, kaolin, aluminium oxide, magnesium oxide, silicon oxide, titanium oxide, Yttrium oxide, zinc oxide, aluminium titanate, carbides and mixtures thereof. Examples of clay are green montmorillonite and white kaolin clays. Examples of carbides are silicon carbide and tungsten carbide.

If additives are added, their concentration in the dry coating can be up to 40 wt % and is comprised preferably between 10 and 40 wt % and more preferably between 15 and 35 wt %. When green montmorillonite is added, the ratio between the graphene weight content and the green montmorillonite weight content is preferably comprised between 0.2 and 0.8.

According to one variant of the invention, the coating consists of nanographites, a binder based on sodium silicate and optional additives selected among clay, silica, quartz, kaolin, aluminium oxide, magnesium oxide, silicon oxide, titanium oxide, Yttrium oxide, zinc oxide, aluminium titanate, carbides and mixtures thereof.

Preferably, the dry thickness of the coating is between 10 and 250 μm. More preferably, it is between 110 and 150 μm. For example, the thickness of the coating is between 10 and 100 μm or between 100 and 250 μm.

Preferably, the coating does not comprise at least one element chosen from a surfactant, an alcohol, aluminum silicate, aluminum sulfate, aluminum hydroxide, aluminum fluoride, copper sulfate, lithium chloride and magnesium sulfate.

The invention also relates to a method for the manufacture of the coated stainless-steel substrate according to the present invention, comprising the successive following steps:

A. The provision of a stainless-steel substrate according to the present invention, B. The deposition on at least a part of the stainless-steel substrate of an aqueous mixture comprising nanographites and a binder being sodium silicate to form the coating according to the present invention, C. Optionally, the drying of the coated stainless-steel substrate obtained in step B).

In step A), the stainless-steel substrate can be provided in any size, dimensions and shapes. It can notably be in the form of a strip, a sheet, a piece, a part, an element, a device, an equipment . . . . It can be flat or shaped by any means.

Preferably, in step B), the deposition of the coating is performed by spin coating, spray coating, dip coating or brush coating.

Advantageously, in step B), the aqueous mixture comprises from 40 to 110 g/L of nanographites. More preferably, the aqueous mixture comprises from 40 to 60 g/L of nanographites.

Advantageously, in step B), the aqueous mixture comprises from 40 to 80 g/L of binder. Preferably, the aqueous mixture comprises from 50 to 70 g/L of binder.

Sodium silicate can be added to the aqueous mixture in the form of an aqueous solution. Sodium silicate may also be in a hydrated form, of general formula $(Na_2O)_x(SiO_2)_y \cdot zH_2O$, such as for example $Na_2SiO_3$ $5H_2O$ or $Na_2Si_3O_7$ $3H_2O$.

Advantageously, in step B), the ratio in weight of nanographites with respect to binder is between 0.05 and 0.9, preferably between 0.1 and 0.5.

According to one variant of the invention, the aqueous mixture of step B) further comprises additives, notably to improve the thermal stability and/or the abrasion resistance of the coating. Such additives can be selected among clay, silica, quartz, kaolin, aluminium oxide, magnesium oxide, silicon oxide, titanium oxide, Yttrium oxide, zinc oxide, aluminium titanate, carbides and mixtures thereof. Examples of clay are green montmorillonite and white kaolin clays. Examples of carbides are silicon carbide and tungsten carbide. Clays further help adapting the viscosity of the aqueous mixture to further facilitate its application. In this regard, when green montmorillonite is added, the ratio between the graphene weight content and the green montmorillonite weight content is preferably comprised between 0.2 and 0.8.

In a preferred embodiment, the coating is dried, i.e. is actively dried as opposed to a natural drying in the air, in a step C). It is believed that the drying step allows for an improvement of the coating adhesion since the removal of water is better controlled. In a preferred embodiment, in step C), the drying is performed at a temperature between 50 and 150° C. and preferably between 80 and 120° C. The drying can be performed with forced air.

Advantageously, in step C), when a drying is applied, the drying is performed during 5 to 60 minutes and for example, between 15 and 45 minutes.

In another embodiment, no drying step is performed. The coating is left to dry in the air.

The invention also relates to the use of a coated stainless steel according to the present invention for the manufacture of a snout, an overflow, a sink roll, a stabilizing roll, a roll supporting arm, a pipeline or a pumping element.

The invention also relates to a process of hot dip coating a steel strip comprising a step of moving the steel strip through a molten metal bath comprising a piece of equipment at least partially immersed in the bath wherein at least a part of the piece of equipment is made of a coated stainless steel substrate according to the invention.

The invention also relates to a hot dip coating facility comprising a molten metal bath comprising a piece of equipment at least partially immersed in the bath wherein at least a part of the piece of equipment is made of a coated stainless steel substrate according to the invention.

The invention will now be explained based on trials carried out for information only. They are not limiting.

EXAMPLES

In the examples, the steel substrates having the following composition in weight percent were used:

| Steel | C | Mn | Si | P | S | Cr | Ni | Mo | N | Ce |
|---|---|---|---|---|---|---|---|---|---|---|
| 1 | 0.08 | 2 | 0.75 | 0.045 | 0.03 | 17 | 12 | 2.5 | 0.1 | — |
| 2 | 0.08 | 0.8 | 1.8 | 0.04 | 0.03 | 21 | 11 | — | 0.2 | 0.06 |

Steel 1 corresponds to 316 stainless steel and Steel 2 corresponds to 253MA® stainless steel.

Example 1: Coating Adhesion Test

For Trials 1 and 2, stainless steels 1 and 2 were coated by brushing an aqueous mixture comprising 50 g/L of nanographites having a lateral size between 2 to 10 μm, a width between 2 to 15 μm and a thickness between 1 to 100 nm and 60 g/L of sodium silicate, as a binder, in the form of an aqueous solution comprising 25.6-27.6 wt % of $SiO_2$ and 7.5-8.5 wt % of $Na_2O$. Then, the coating was dried inside a furnace with hot air during 60 minutes at 75° C. The coating was 130 μm thick and comprised 45 wt % of nanographites and 55 wt % of binder.

For Trials 3 and 4, stainless steels 1 and 2 were coated by brushing an aqueous mixture comprising 50 g/L of nanographites having a lateral size between 2 to 10 μm, a width between 2 to 15 μm and a thickness between 1 to 100 nm, 100 g/L of green montmorillonite clay and 60 g/L of sodium silicate, as a binder, in the form of an aqueous solution comprising 25.6-27.6 wt % of $SiO_2$ and 7.5-8.5 wt % of $Na_2O$. Then, the coating was dried inside a furnace with hot air during 60 minutes at 75° C. The coating was 130 μm thick and comprised 11 wt % of nanographite, 69 wt % of binder and 20 wt % of green montmorillonite clay.

For Trials 5 and 6, stainless steels 1 and 2 were coated by brushing an aqueous mixture comprising 90 g/L of nanographites having a lateral size between 2 to 10 μm, a width between 2 to 15 μm and a thickness between 1 to 100 nm, and 60 g/L of sodium silicate, as a binder, in the form of an aqueous solution comprising 25.6-27.6 wt % of $SiO_2$ and 7.5-8.5 wt % of $Na_2O$. Then, the coating was dried inside a furnace with hot air during 60 minutes at 75° C. The coating was 130 μm thick and comprised 60 wt % of nanographite, 40 wt % of binder.

For Trials 7 and 8, stainless steels 1 and 2 were coated by brushing an aqueous mixture comprising 50 g/L of reduced graphene oxide having a lateral size between 5 to 30 μm, a width between 5 to 30 μm and a thickness between 1 to 10 nm and 60 g/L of sodium silicate, as a binder, in the form of an aqueous solution comprising 25.6-27.6 wt % of $SiO_2$ and 7.5-8.5 wt % of $Na_2O$. Then, the coating was dried inside a furnace with hot air during 60 minutes at 75° C. The coating was 130 μm thick and comprised 45 wt % of reduced graphene oxide and 55 wt % of binder.

To evaluate the coating adhesion, an adhesive tape was deposited on the Trials and then removed. The coating adhesion was evaluated by visual inspection on the Trials: 0 means that all the coating has remained on the stainless steel; 1 means that some parts of the coating has been removed and 2 means that almost all the coating has been removed.

The results are in the following Table 1:

| Trials | Steels | Coating | Adhesion |
|---|---|---|---|
| 1* | 1 | nanographites and sodium silicate | 0 |
| 2* | 2 | nanographites and sodium silicate | 0 |
| 3* | 1 | Nanographites, montmorillonite green clay and sodium silicate | 0 |
| 4* | 2 | Nanographites, montmorillonite green clay and sodium silicate | 0 |
| 5* | 1 | nanographites and sodium silicate | 0 |
| 6* | 2 | nanographites and sodium silicate | 0 |
| 7 | 1 | Reduced graphene oxide and sodium silicate | 1 |
| 8 | 2 | Reduced graphene oxide and sodium silicate | 2 |

*according to the present invention.

Trials according to the present invention show an excellent coating adhesion.

Example 2: Bath Immersion

Trials 1 to 6 were immersed 2 weeks in a zinc-based bath comprising 0.2% of Al and 0.02% of Fe. After 2 weeks, a non-adherent zinc thin film was present on the Trials. The zinc film was easily peeled off from the Trials. The coating of the present invention was still present on all Trials. No attack of zinc appeared.

The Trials according of the present invention were well protected against zinc attack.

Trials 5 and 6 were also immersed 8 days in an aluminium-based bath comprising 10% of Si and 2.5% of Fe. After 8 days, a non-adherent metallic thin film was present on the Trials. The metallic film was easily peeled off from the Trials. The coating of the present invention was still present on both Trials. No attack of aluminium appeared.

The Trials according of the present invention were well protected against aluminium attack.

What is claimed is:

1. A coated stainless-steel substrate comprising:

a stainless-steel substrate; and a coating comprising nanographites and a binder being sodium silicate, wherein the stainless-steel substrate has the following composition in weight percent:

C≤1.2%,
Cr≥11.0%,
Ni≥8.0%
0.0%≤Nb≤6.0%,
0.0%≤B≤1.0%,
0.0%≤Ti≤3.0%,
0.0%≤Cu≤5.0%,
0.0%≤Co≤3.0%,
0.0%≤N≤1.0%,
0.0%≤V≤3.0%,
0.0%≤Si≤4.0%,
0.0%≤Mn≤5.0%,
0.0%≤P≤0.5%,
0.0%≤S≤0.5%,
0.0%≤Mo≤6.0%,
0.0%≤Ce≤1.0%, a remainder of the composition being made of iron and inevitable impurities resulting from processing.

2. The coated stainless-steel substrate as recited in claim 1 wherein a lateral size of the nanographites is between 1 and 65 μm.

3. The coated stainless-steel substrate as recited in claim 1 wherein a width size of the nanographites is between 2 to 15 μm.

4. The coated stainless-steel substrate as recited in claim 1 wherein a thickness of the nanographites is between 1 to 100 nm.

5. The coated stainless-steel substrate as recited in claim 1 wherein a concentration of nanographites in the coating is between 5% and 70% by weight.

6. The coated stainless-steel substrate as recited in claim 1 wherein a concentration of sodium silicate in the coating is between 35% and 75% by weight.

7. The coated stainless-steel substrate as recited in claim 1 wherein a ratio in weight of nanographites with respect to the binder is between 0.05 and 0.9.

8. The coated stainless-steel substrate as recited in claim 1 wherein a thickness of the coating is between 10 and 250 μm.

9. The coated stainless-steel substrate as recited in claim 1 wherein the coating further comprises clay, silica, quartz, kaolin, aluminium oxide, magnesium oxide, silicon oxide, titanium oxide, yttrium oxide, zinc oxide, aluminium titanate, carbides or mixtures thereof.

10. The coated stainless-steel substrate as recited in claim 1, wherein the coating consists of the nanographites, the binder and optional additives selected from a group consisting of clay, silica, quartz, kaolin, aluminium oxide, magnesium oxide, silicon oxide, titanium oxide, yttrium oxide, zinc oxide, aluminium titanate, carbides and mixtures thereof.

11. The coated stainless-steel substrate as recited in claim 1, wherein a lateral size of the nanographites is between 1 and 65 μm, a width size of the nanographites is between 2 to 15 μm, and a thickness of the nanographites is between 1 to 100 nm.

12. A coated stainless-steel substrate comprising:

a stainless-steel substrate; and a coating comprising nanographites and a binder being sodium silicate, wherein the stainless-steel substrate has the following composition in weight percent:

C≤1.2%,
Cr≥11.0%,
Ni≥8.0%
0.0%≤Nb≤6.0%,
0.0%≤B≤1.0%,
0.0%≤Ti≤3.0%,
0.0%≤Cu≤5.0%,
0.0%≤Co≤3.0%,
0.0%≤N≤1.0%,
0.0%≤V≤3.0%,
0.0%≤Si≤4.0%,
0.0%≤Mn≤5.0%,
0.0%≤P≤0.5%,
0.0%≤S≤0.5%,
0.0%≤Mo≤6.0%,
0.0%≤Ce≤1.0%, a remainder of the composition being made of iron and inevitable impurities resulting from processing, wherein a concentration of nanographites in the coating is between 10% and 70% by weight.

13. The coated stainless-steel substrate as recited in claim 12 wherein a concentration of nanographites in the coating is between 10% and 65% by weight.

14. The coated stainless-steel substrate as recited in claim 13 wherein a lateral size of the nanographites is between 1 and 65 μm, a width size of the nanographites is between 2 to 15 μm, and a thickness of the nanographites is between 1 to 100 nm.

15. The coated stainless-steel substrate as recited in claim 13 wherein a ratio in weight of nanographites with respect to the binder is between 0.05 and 0.9.

16. A method for the manufacture of the coated stainless-steel substrate as recited in claim 1 comprising the successive following steps:

A. providing a stainless-steel substrate comprising in weight percent at most 1.2% C, at least 11.0% Cr and at least 8.0% Ni, a remainder of the composition being made of iron and inevitable impurities resulting from processing, B. depositing on at least a part of the stainless-steel substrate of an aqueous mixture comprising nanographites and a binder being sodium silicate to form a coating.

17. The method as recited in claim 16 further comprising drying the coating obtained in step B).

18. The method as recited in claim 17 wherein the drying is performed at a temperature between 5° and 150° C.

19. The method as recited in claim 16 wherein in step B), the aqueous mixture comprises from 40 to 110 g/L of nanographites and from 40 to 80 g/L of binder.

20. A method for hot dip coating a steel strip comprising a step of moving the steel strip through a molten metal bath comprising a piece of equipment at least partially immersed in the bath, at least a part of the piece of equipment being made of the coated stainless-steel substrate as recited in claim 1.

21. A hot dip coating facility comprising a molten metal bath comprising a piece of equipment at least partially immersed in the bath, at least a part of the piece of equipment being made of the coated stainless-steel substrate as recited in claim 1.

22. The hot dip coating facility as recited in claim 21 wherein the piece of equipment is selected from the group consisting of a snout, an overflow, a sink roll, a stabilizing roll, a roll supporting arm, a roll flange, a pipeline and a pumping element.

* * * * *